US009586772B2

(12) United States Patent
Tanaka et al.

(10) Patent No.: US 9,586,772 B2
(45) Date of Patent: Mar. 7, 2017

(54) SHEET FEEDER AND IMAGE FORMING APPARATUS

(71) Applicant: KYOCERA Document Solutions Inc., Osaka (JP)

(72) Inventors: Yuichiro Tanaka, Osaka (JP); Masuo Kawamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/736,046

(22) Filed: Jun. 10, 2015

(65) Prior Publication Data

US 2015/0375950 A1 Dec. 31, 2015

(30) Foreign Application Priority Data

Jun. 26, 2014 (JP) ..... 2014-131599

(51) Int. Cl.
*B65H 1/04* (2006.01)
*B65H 3/66* (2006.01)

(52) U.S. Cl.
CPC ..... *B65H 1/04* (2013.01); *B65H 3/66* (2013.01); *B65H 2404/54* (2013.01);
(Continued)

(58) Field of Classification Search
CPC .... B65H 1/04; B65H 3/66; B65H 2405/1142; B65H 2407/21; B65H 2405/111;
(Continued)

(56) References Cited

U.S. PATENT DOCUMENTS 5,377,966 A * 1/1995 Ohmori ..... G03G 15/60 271/223
6,406,201 B1 * 6/2002 Beretta ..... B41J 13/103 400/605

(Continued)

FOREIGN PATENT DOCUMENTS

JP S59-105238 U 7/1984
JP H05-238607 A 9/1993

(Continued)

OTHER PUBLICATIONS

An Office Action; "Notice of Reasons for Rejection," issued by the Japanese Patent Office on Apr. 26, 2016, which corresponds to Japanese Patent Application No. 2014-131599 and is related to U.S. Appl. No. 14/736,046.

(Continued)

*Primary Examiner* — Jeremy R Severson
(74) *Attorney, Agent, or Firm* — Studebaker & Brackett PC

(57) ABSTRACT

A sheet feeder includes a tray configured to load a sheet to be fed thereon. The tray has a tray upper face and a pair of cursors. The tray upper face has a recessed portion, a guide plate and a feeding route. The recessed portion extends along the width direction on an upstream side from the pair of cursors in the feeding direction. The guide plate is configured to cover an upper side of the recessed portion. The feeding route is formed between the recessed portion and the guide plate and extending from an inlet port positioned on an upstream side to an outlet port positioned on a downstream side along the feeding direction. The sheet in a state of being passed through the feeding route is aligned with the pair of cursors on the tray upper face and then fed.

15 Claims, 8 Drawing Sheets

(52) U.S. Cl.
CPC *B65H 2405/1142* (2013.01); *B65H 2405/324* (2013.01); *B65H 2407/21* (2013.01); *B65H 2511/12* (2013.01); *B65H 2511/22* (2013.01); *B65H 2801/06* (2013.01)

(58) Field of Classification Search
CPC ..... B65H 2405/1111; B65H 3/54; B65H 3/68; B65H 2405/33; B65H 2405/332; B65H 3/44
See application file for complete search history.

(56) References Cited

U.S. PATENT DOCUMENTS 7,547,011 B2 * 6/2009 Kurata ..... B41J 11/0025 271/157
7,628,392 B2 * 12/2009 Shiohara ..... B65H 1/04 271/111
7,909,318 B2 * 3/2011 Kim ..... B65H 3/44 271/9.07
8,556,250 B2 * 10/2013 Takahata ..... B65H 3/063 271/171
8,764,004 B2 7/2014 Taniguchi
9,036,221 B2 * 5/2015 Ohta ..... H04N 1/00519 358/474
2012/0248687 A1 * 10/2012 Takahata ..... B65H 3/063 271/253
2013/0164064 A1 * 6/2013 Matsumoto ..... B65H 1/04 399/361
2016/0272443 A1 * 9/2016 Seto ..... B65H 1/04

FOREIGN PATENT DOCUMENTS

JP H07-017642 A 1/1995
JP H10-045284 A 2/1998
JP 2000-318885 A 11/2000
JP 2003-054789 A 2/2003
JP 2013-103783 A 5/2013

OTHER PUBLICATIONS

An Office Action; "Notification of Reasons for Refusal" issued by the Japanese Patent Office on Jul. 5, 2016, which corresponds to Japanese Patent Application No. 2014-131599 and is related to U.S. Appl. No. 14/736,046; with English language translation.

* cited by examiner

SHEET FEEDER AND IMAGE FORMING APPARATUS

INCORPORATION BY REFERENCE

This application is based on and claims the benefit of priority from Japanese Patent application No. 2014-131599 filed on Jun. 26, 2014, the entire contents of which are incorporated herein by reference.

BACKGROUND

The present disclosure relates to a sheet feeder configured to feed a sheet to an image forming apparatus or the like and an image forming apparatus including the sheet feeder.

An image forming apparatus, such as a multifunction peripheral or a printer, is configured such that a regular size sheet is fed from a sheet feeding cartridge and a non-regular size sheet, such as a card or an elongated sheet, is fed from a manual bypass tray.

The manual bypass tray is provided with a pair of cursors which synchronously slide close to or spaced from each other about a center of a width direction of the sheet, and by the pair of cursors, the sheet is aligned with the center of the width direction to correct skew of the sheet.

However, in a case where an elongated sheet (1,200 mm in length, for example) used for a banner or the like is fed from the manual bypass tray, if a leading end of the sheet may skew, a degree of skew increases toward a rear end of the sheet due to a self-weight or the like of a portion which is not loaded on the manual bypass tray.

FIG. 8 shows an example of a sheet feeding state in a case where the degree of skew increases. FIG. 8 is a view showing the manual bypass tray viewed in a sheet feeding direction. In a case where a sheet feeding is normally carried out, a sheet S (indicated by the solid line of FIG. 8) is aligned with the center of the width direction by a pair of cursors 101F, 101R on a tray 100. On the other hand, when an elongated sheet S1 (indicated by double-dotted chain line of FIG. 8) is fed obliquely to a normal conveying direction, the elongated sheet S1 may run on the front side cursor 101F. In such a case, the skew correction effect exerted by the pair of cursors 101F, 101R is not obtained and, therefore, the elongated sheet S1 is fed with the skew. As a result, a wrinkle may occur on the elongated sheet S1 or a side edge of the elongated sheet S1 may be damaged.

There is a sheet feeder in which a sheet receiving member to roll-bend and support an elongated sheet protruded from the manual bypass tray is removably provided at the manual bypass tray. Also, there is a sheet feeder configured such that a respective one of a pair of cursors is formed with fold parts bent on the sheet side (inside) to force a portion of the sheet out of the conveying path into the conveying path.

However, in the sheet feeder in which the sheet receiving member is provided, there is a need to mount the sheet receiving member every time the elongate sheet is fed or there is a need to secure a storage place for the sheet receiving member and thus there is a problem that workability of sheet feeding work is poor. Also, in the sheet feeder in which the fold part is formed at the respective cursor, as shown in FIG. 8, in a case where a degree of skew is great and the sheet runs over the cursor, a sufficient advantageous effect may not be attained.

SUMMARY

In accordance with an embodiment of the present disclosure, a sheet feeder includes a tray configured to load a sheet to be fed thereon. The tray has a tray upper face on which the sheet is placed and a pair of cursors configured to be contact with side edges of the sheet placed on the tray upper face to align the sheet in a width direction of the sheet orthogonal to a feeding direction of the sheet. The tray upper face has a recessed portion, a guide plate and a feeding route. The recessed portion extends along the width direction on an upstream side from the pair of cursors in the feeding direction. The guide plate is configured to cover an upper side of the recessed portion. The feeding route is formed between the recessed portion and the guide plate and extending from an inlet port positioned on an upstream side to an outlet port positioned on a downstream side along the feeding direction. The sheet in a state of being passed through the feeding route is aligned with the pair of cursors on the tray upper face and then fed.

In accordance with an embodiment of the present disclosure, an image forming apparatus includes an image forming part, a sheet feeding part configured to convey a sheet to the image forming part and a sheet feeder configured to feed the sheet to the sheet feeding part. The sheet feeder has a tray configured to load a sheet to be fed thereon. The tray has a tray upper face on which the sheet is placed and a pair of cursors configured to be contact with side edges of the sheet placed on the tray upper face to align the sheet in a width direction of the sheet orthogonal to a feeding direction of the sheet. The tray upper face has a recessed portion, a guide plate and a feeding route. The recessed portion extends along the width direction on an upstream side from the pair of cursors in the feeding direction. The guide plate is configured to cover an upper side of the recessed portion. The feeding route is formed between the recessed portion and the guide plate and extending from an inlet port positioned on an upstream side to an outlet port positioned on a downstream side along the feeding direction. The sheet in a state of being passed through the feeding route is aligned with the pair of cursors on the tray upper face and then fed.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, a sheet feeder and an image forming apparatus according to an embodiment of the present disclosure will be described.

Figure 1:
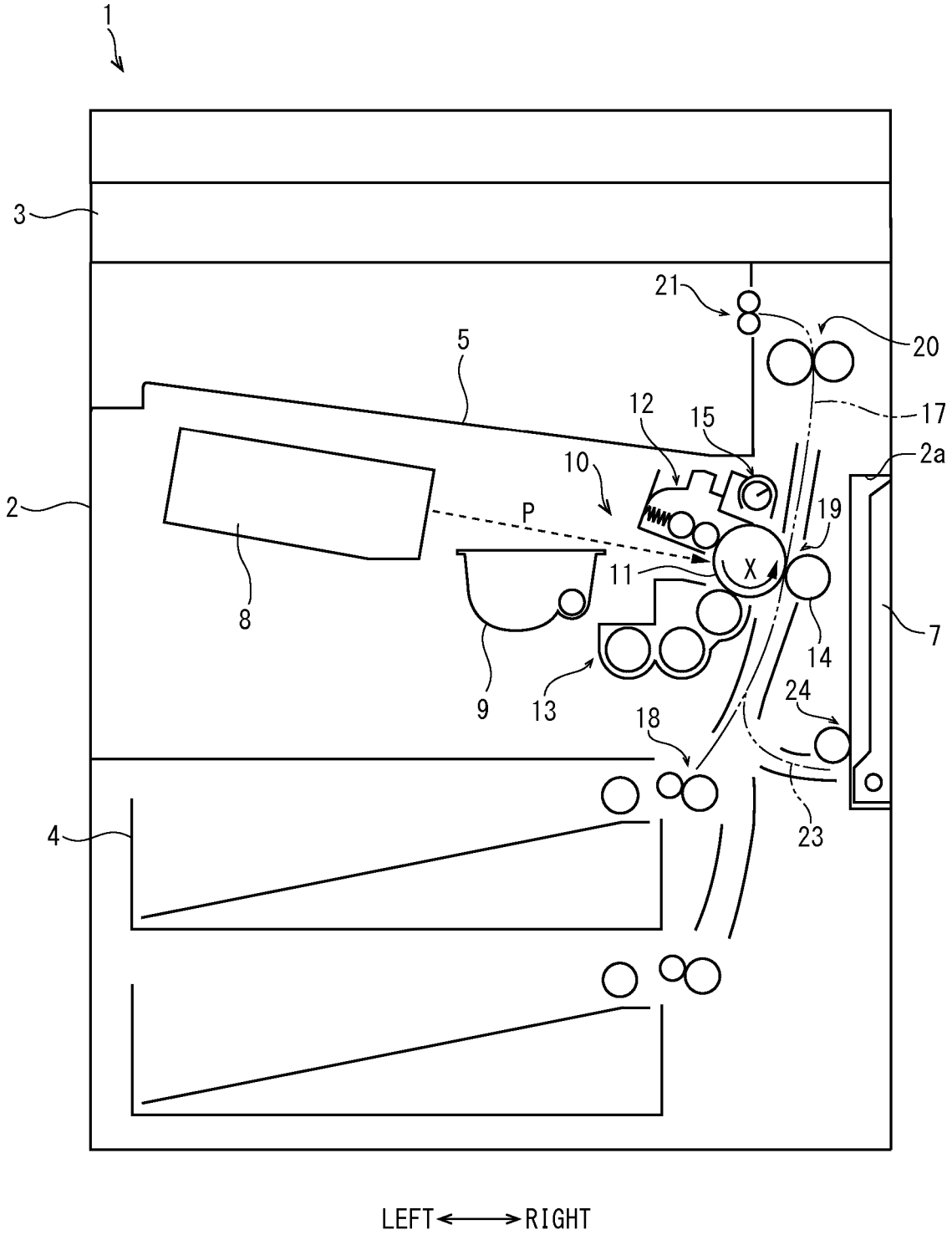
FIG. 1 is a front view schematically showing an internal structure of a printer according to an embodiment of the present disclosure.

With reference to FIG. 1, a printer (an image forming apparatus) according to one embodiment of the present disclosure will be described. FIG. 1 is a schematic diagram illustrating an internal structure of the printer. In the following description, a near side on a paper plane indicates a front side of the printer 1 and left and right directions are based on a direction viewed from the front side of the printer.

The printer 1 includes a box-formed printer main body 2 as shown in FIG. 1. At an upper end of the printer 1, an image reading device 3 is provided. In a lower part of the printer main body 2, a sheet feeding cartridge 4 storing a sheet (not shown) is arranged and, on a front portion of a top face of the printer main body 2, a sheet ejected tray 5 is formed. On a right side face of the printer main body 2, a concave portion 2*a* is formed, in which a manual sheet feeder 7 (a sheet feeder) is supported rotatably around the lower end.

Inside the printer main body 2, an exposure device 8 composed of a laser scanning unit (LSU) is arranged under the sheet ejected tray 5. On a right side of the exposure device 8, a toner container 9 is arranged. On a right side of the toner container 9, an image forming part 10 is provided. In the image forming part 10, a photosensitive drum 11 as an image carrier is rotatably provided. Around the photosensitive drum 11, a charger 12, a development unit 13, a transfer roller 14 and cleaning device 15 are located along a rotating direction (refer to an arrow X in FIG. 1) of the photosensitive drum 11.

Inside the printer main body 2, a sheet conveying path 17 from the sheet feeding cartridge 3 toward the sheet ejected tray 5 is provided. Along the sheet conveying path 17, a sheet feeding part 18, a transferring part 19 formed by the photosensitive drum 11 and the transfer roller 14, a fixing device 20 and sheet ejecting part 21 are arranged in the order from the upstream side in the sheet conveying direction. Furthermore, a manual bypass path 23 extending from the manual sheet feeder 7 is joined into the sheet conveying path 17 between the sheet feeding part 18 and the transferring part 19. On the downstream side of the manual bypass path 23, a manual sheet feeding part 24 is provided.

Next, an operation of forming an image by the printer 1 having such a configuration will be described.

When the power is supplied to the printer 1, various parameters are initialized in a control circuit and initial determination, such as temperature determination of the fixing device 20, is carried out. Subsequently, when image data is inputted and a printing start is directed from a computer or the like connected with the printer 1, image forming operation is carried out as follows.

First, a surface of the photosensitive drum 11 is electric-charged by the charger 12. Then, exposure corresponding to the image data on the photosensitive drum 11 is carried out by a laser light (refer to two-dashed line P in FIG. 1) from the exposure device 8, thereby forming an electrostatic latent image on the surface of the photosensitive drum 11. Subsequently, the electrostatic latent image is developed by the development unit 13 into a toner image with the toner supplied from the toner container 9.

On the other hand, a sheet fed from the sheet feeding cartridge 4 by the sheet feeding part 18 or from the manual sheet feeder 7 by the manual sheet feeding part 24 is conveyed to the transferring part 19 in a suitable timing for the above-mentioned image forming operation, and then, the toner image on the photosensitive drum 11 is transferred on the sheet in the transferring part 19. The sheet with the transferred toner image is conveyed on a downstream side in the conveying path 17 to go forward to the fixing device 20, and then, the toner image is fixed on the sheet in the fixing device 20. The sheet with the fixed toner image is ejected from the sheet ejecting part 21 to the sheet ejected tray 5. The toner remained on the photosensitive drum 11 is collected by the cleaning device 15.

Figure 2:
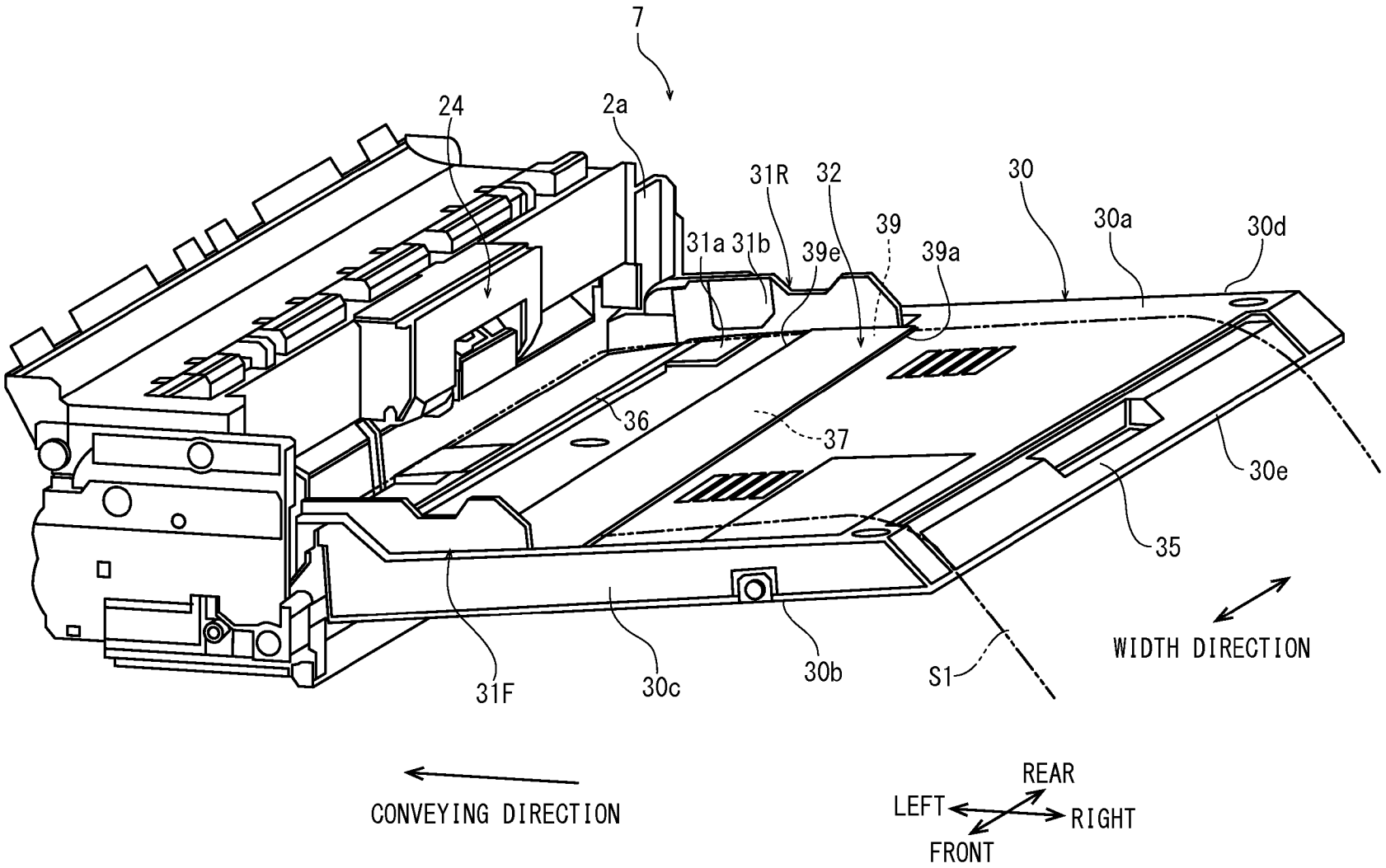
FIG. 2 is a perspective view of a sheet feeder according to a first embodiment of the present disclosure.
Figure 3:
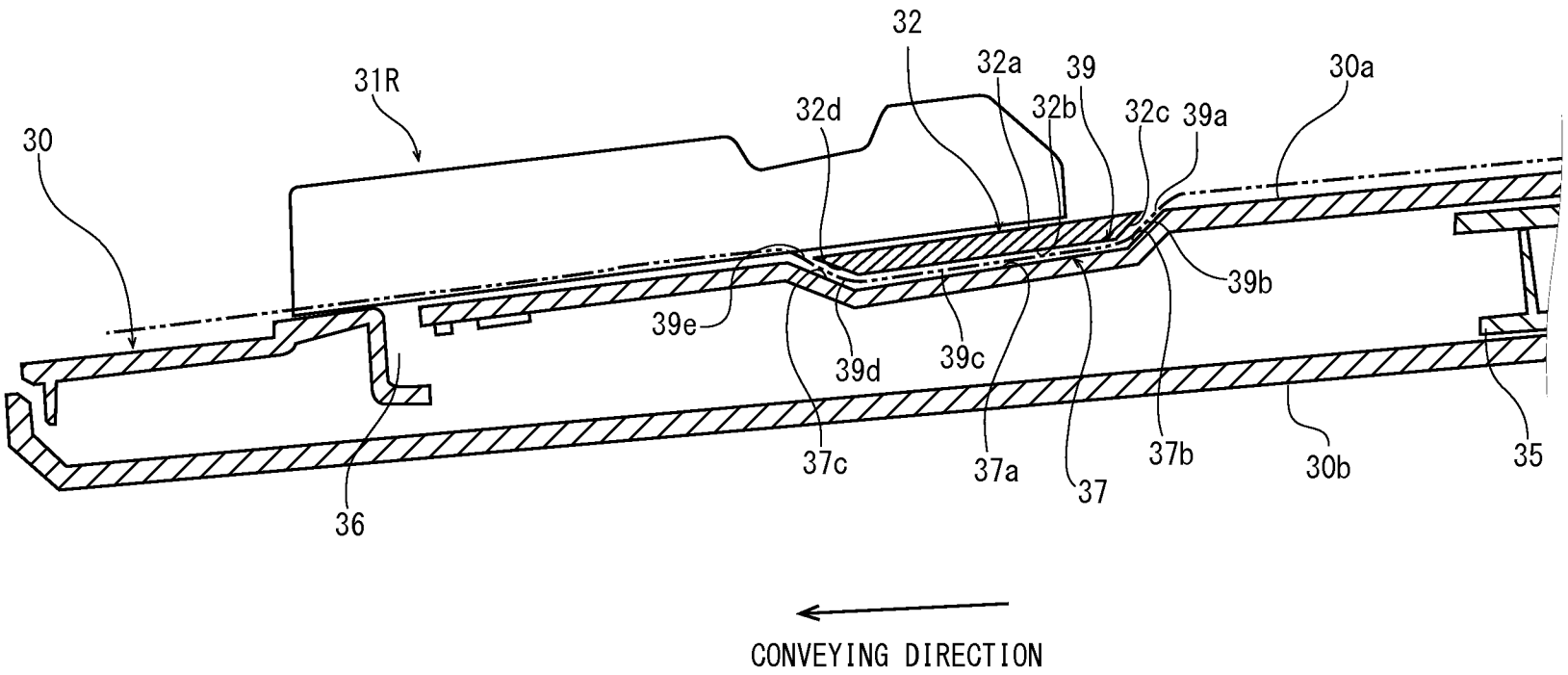
FIG. 3 is a sectional front view of the sheet feeder according to the first embodiment of the present disclosure.

Next, the manual sheet feeder 7 according to a first embodiment will be described with reference to FIG. 2 and FIG. 3. FIG. 2 is a perspective view of the manual sheet feeder, and FIG. 3 is a sectional view of a tray of the manual sheet feeder.

The manual sheet feeder 7 includes: a tray 30 on which a sheet to be fed is placed; and a pair of cursors 31F, 31R to align the sheet placed on the tray 30.

The tray 30, as shown in FIG. 2, is a rectangular planar shaped flat hollow member having a predetermined thickness, and has: an upper face 30*a* on which a sheet is placed; a bottom face 30*b* opposing to the upper face 30*a*; and front and rear side faces 30*c*, 30*d* on both sides in a sheet width direction orthogonal to the sheet feeding direction; and an upstream-side end face 30*e* in the sheet feeding direction. On the front and rear side faces 30*c*, 30*d* of the tray 30, supporting shafts (not shown) protruding outwardly are coaxially formed at the downstream-side end in the sheet feeding direction. The supporting shafts are rotatably supported to bearing parts (not shown) formed on front and rear side faces of the concave portion 2*a* of the printer main body 2. In this manner, the tray 30 is turnable around the supporting shaft between a housing position in which the tray 30 is housed in the concave portion 2*a* of the printer main body 2 in an erected posture and a manual feed position (refer to FIG. 2) protruding substantially horizontally from the printer main body 2.

In the hollow of the tray 30, an extension tray 35 is housed. The extension tray 35 is capable of protruding in an upstream direction from the upstream-side end face 30*e* of the tray 30.

On the upper face 30*a* of the tray 30, a guide groove 36 extending in the sheet width direction is formed at a downstream side portion in the sheet feeding direction. Further, on the upstream side of the guide groove 36 in the sheet feeding direction, a shallow recessed portion 37 extending in the sheet width direction is formed. The recessed portion 37, as shown in FIG. 3, has a predetermined length along the sheet feeding direction, and has: a flat bottom face 37*a* inclined slightly downward toward the downstream side in the feeding direction; an upstream-side inclined face 37*b* inclined from an upstream-side end edge of the bottom face 37*a* toward the upper face 30*a* of the tray 30; and a downstream-side inclined face 37*c* inclined from the downstream-side end edge of the bottom face 37*a* toward the upper face 30*a* of the tray 30.

Over the recessed portion 37, a guide plate 32 is covered. The guide plate 32 is a flat plate-shaped member, and has a width in the sheet width direction equal to a width of the recessed portion 37 formed on the upper face 30*a* of the tray 30 and a length in the sheet feeding direction slightly shorter than a length of the recessed portion 37. The guide plate 32, as shown in FIG. 3, has: a flat upper face 32*a* and a flat lower face 32*b*; an upstream-side side face 32*c* inclined downward from an upstream-side end edge of the upper face 32*a* toward an upstream-side end edge of the lower face 32*b*; and a downstream-side side face 32*d* inclined upward from a downstream-side end edge of the lower face 32*b* toward a downstream-side end edge of the upper face 32*a*.

The guide plate 32 is disposed between the both ends of the recessed portion 37 in the width direction, the upper face 32*a* is positioned substantially on the same plane with the upper face 32*a* of the tray 30, and the lower face 32*b* and the upstream-side side face 32*a* and the downstream-side side face 32*d* respectively face the bottom face 37*a* and the upstream-side inclined face 37*b* and the downstream-side inclined face 37*c* of the recessed portion 37 via predetermined gaps.

By forming such gaps, a feeding route 39 is formed from an inlet port 39*a* between an upstream-side end edge of the upstream-side side face 32*a* of the guide plate 32 and an upstream-side end edge of the upstream-side inclined face 37*b* of the recessed portion 37, through an upstream-side inclined route 39*b* between the upstream-side side face 32*c* of the guide plate 32 and the upstream-side inclined face 37*b* of the recessed portion 37, a linear route 39*c* between the lower face 32*b* of the guide plate 32 and the bottom face 37*a* of the recessed portion 37, and a downstream-side inclined route 39*d* between the downstream-side side face 32*d* of the guide plate 32 and the downstream-side inclined face 37*c* of the recessed portion 37, toward an outlet port 39*e* between a downstream-side end edge of the downstream-side side face 32*d* of the guide plate 32 and a downstream-side end edge of the downstream-side inclined face 37*c* of the recessed portion 37. The feeding route 39 is configured to have a height such that a sheet can pass through the feeding route 39.

The pair of cursors 31F, 31R are provided so as to be synchronously slid close to or spaced from each other about the center in the sheet width direction on the tray 30. Each of the cursors 31F, 31R, as shown in FIG. 2, has a symmetrical shape in the sheet feeding direction, and includes: a rectangular proximal part 31*a* having a face along the upper face 30*a* of the tray 30; and a side part 31*b* erected from an outside edge of the proximal part 31*a* in the sheet width direction. The side part 31*b* is extended on the upstream side from the proximal part 31*a* in the sheet feeding direction.

The respective one of the pair of cursors 31F, 31R is formed with a protrusion piece (not shown) on a bottom face of the proximal part 31*a*. The protrusion piece is configured to engage with the guide groove 36 formed on the upper face 30*a* of the tray 30*a*. In the hollow of the tray 30, the respective protrusion pieces engaging with the guide groove 36 are coupled to each other by a rack/pinion mechanism (not shown), and if one cursor 31F is slid in one direction along the groove 36, the other cursor 31R synchronously slides at the same distance in the opposite direction. By such movement of the pair of cursors 31F, 31R, a sheet can be aligned with the center in the sheet width direction on the tray 30. In a state in which the pair of cursors 31F, 31R engage with the guide groove 36, the side part 31*b* extends to the vicinity of an upstream-side end of the recessed portion 37 of the upper face 30*a* of the tray 30.

A method for manually feeding an elongated sheet in the manual sheet feeder 7 having the above construction will be described with reference to FIG. 2 and FIG. 3. For example, in a case where an elongated sheet S1 having a length of 1,200 mm is manually fed, a leading end of the elongated sheet S is first inserted under the guide plate 32 from the inlet port 39*a* of the feeding route 39 formed between the recessed portion 37 of the upper face 30*a* of the tray 30 and the guide plate 32 and then pulled out from the outlet port 39*e*. Furthermore, between the respective side parts 31*b* of the pair of cursors 31F, 31R, through the upper faces of the respective proximal parts 31*a*, the elongated sheet S1 is set so as to be able to be fed by the manual sheet feeding part 24. When an image forming operation is then started, the elongated sheet S1 is fed from the manual sheet feeding part 24 and then conveyed along the sheet feeding direction. At this time, the elongated sheet S1 passes through the feeding route 39 formed between the recessed portion 37 of the tray 30 and the guide plate 32, then between the pair of cursors 31F, 31R, and fed to the manual sheet feeding part 24.

On the other hand, in a case where a sheet other than the elongated sheet is manually fed, the sheet is placed on the upper face 30*a* of the tray 30 and aligned with the pair of cursors 31F, 31R without being passed through the feeding route 39 between the recessed portion 37 of the upper face 30*a* of the tray 30 and the guide plate 31, and subsequently, an image forming operation is started.

As described above, in the manual sheet feeder 7 of the embodiment, since the elongated sheet S1 to be manually fed passes between the pair of cursors 31F, 31R with restraining upwardly movement by the guide plate 32 through the feeding route 39, it becomes possible to align the sheet in the width direction by the pair of cursors 31F, 31R. Therefore, even if the elongated sheet S1 is manually fed, the elongated sheet S1 can be fed without skew and, therefore, an image can be formed on the elongated sheet S1 without causing a wrinkle or damage.

Further, at the time of feeding the elongated sheet S1 manually, there is no need to mount exclusive members or there is no need to secure a space exclusively prepared to feed the elongated sheet on the tray 30, thus enabling cost reduction and space saving.

Furthermore, since the upper face of the guide plate 32 is substantially on the same plane with the upper face 30*a* of the tray 30, when a non-regular size sheet other than the elongated sheet S1 is manually fed, the tray 30 has no member interfering with the non-regular size sheet on the upper face 30*a*. Therefore, the non-regular size sheet can be stably fed while aligned with the pair of cursors 31F, 31R.

Although, in the sheet feeder 7 according to the present embodiment, the guide plate 32 is supported by the recessed portion 37 formed on the upper face 30*a* of the tray 30, a method for supporting the guide plate 32 is not limited thereto. For example, a flat plate-shaped guide plate 32 may be supported so as to be able to elevate relative to the upper face 30*a* of the tray 30. In this case, in a case where the elongated sheet is fed, the guide plate 32 is risen and then the elongated sheet is passed between the pair of cursors 31F, 31R through a gap between the upper face 30*a* of the tray 30 and the guide plate 32. Afterwards, the guide plate 32 is lowered to forma feeding route for the elongated sheet between the guide plate 32 and the upper face 30*a* of the tray 30. Since the elongated sheet passes between the pair of cursors 31F, 31R after the upper face have been guided by the guide plate 32 in the feeding route, the elongated sheet can be conveyed without skew. However, there is a need to provide an elevation mechanism of the guide plate 32 and there is a need for the work of elevating the guide plate 32 at the time of feeding of the elongated sheet. Therefore, it is preferable to form the feeding route 39 as in the embodiment since the structure of the sheet feeder 7 can be simplified and the elongated sheet can be easily set.

Next, sheet feeder according to second to fifth embodiments of the present disclosure will be described with reference to FIG. 4 to FIG. 7. FIG. 4 to FIG. 7 respectively are views of the sheet feeder according to the second to fifth embodiments of the present disclosure.

Figure 4:
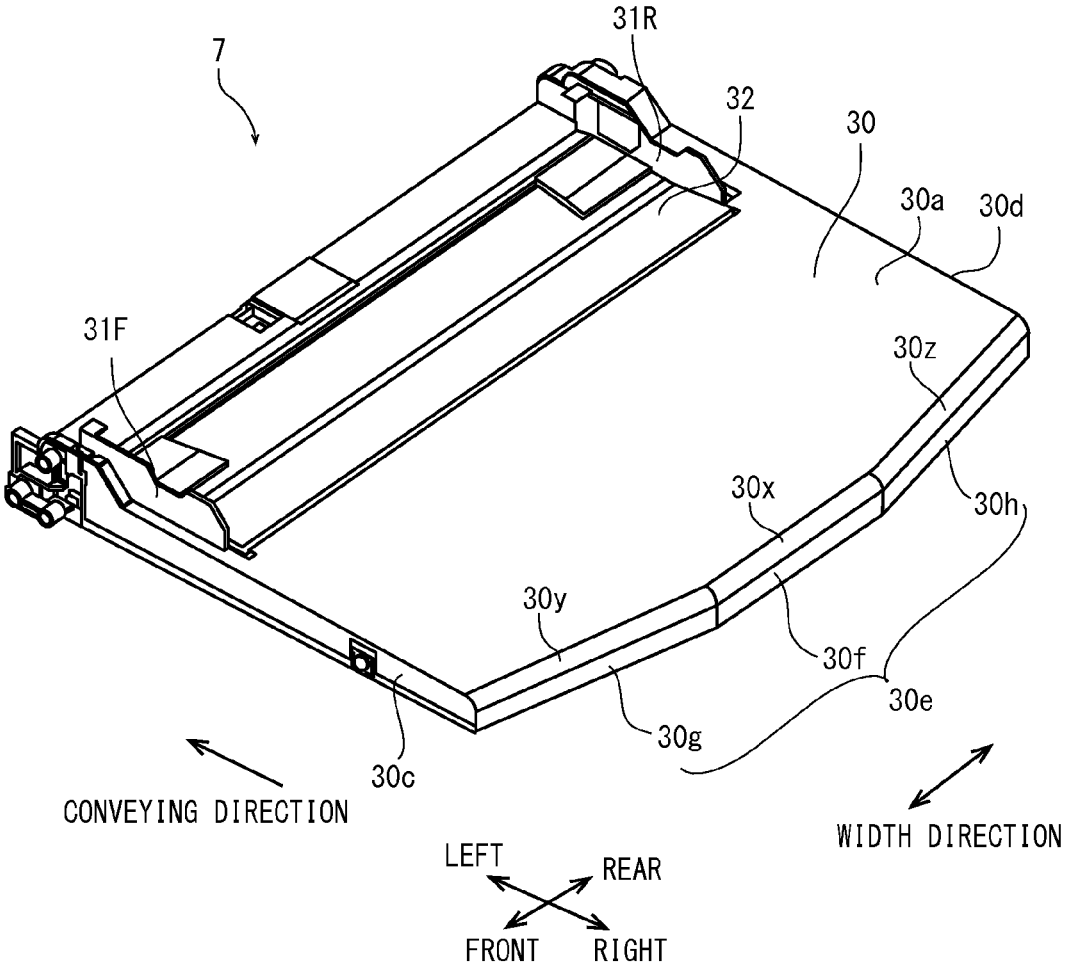
FIG. 4 is a perspective view of a sheet feeder according to a second embodiment of the present disclosure.

In the manual sheet feeder 7 according to the second embodiment shown in FIG. 4, the upstream-side end face 30*e* of the tray 30 is composed of: a center end face 30*f* at the center in the sheet width direction; a front end face 30*g*; and a rear end face 30*h*. The center end face 30*f* is formed in parallel to the frontward and rearward directions (the sheet width direction). The front end face (inclined face) 30*g* is inclined to the downstream side in the sheet feeding direction and the rear end face (inclined face) 30*h* is inclined to the downstream side in the sheet feeding direction.

Further, at corners between the upper face 30*a* of the tray 30, and the center end face 30*f* and the front end face 30*g* and the rear end faces 30*h*, arc-shaped curved parts 30*x*, 30*y*, 30*z* in a side view are respectively formed. The curved parts 30*x*, 30*y*, 30*z* are configured to have a curvature smaller than a curvature of a curved portion of an elongated sheet hanging down from the tray 30.

In a case where the tray 30 does not have the front and rear end faces 30*g*, 30*h*, a corner of a substantially 90 degrees is formed between the upstream-side end face 30*e* of the tray 30, and the front and rear side faces 30*c*, 30*d*. Then, in a case where the elongated sheet is fed with a skewed posture, a side edge portion of the elongated sheet in the width direction is fed along any of the corners of the tray 30. Then, a fold may be formed on the side edge portion at a position coming into contact with the corner or a degree of the skew may be larger due to a higher frictional resistance.

In the manual sheet feeder according to the second embodiment, since the front and rear end faces 30*g*, 30*h* are formed on the upstream-side end face 30*e* of the tray 30, in a case where the elongated sheet is conveyed onto the tray 30 with a skew posture, the elongated sheet can be stably conveyed onto the tray 30 with the skew posture without coming into contact with the corners of the tray 30. Even if the elongated sheet may be conveyed onto the tray 30 with the skew posture, the skew can be corrected by the pair of cursors 31F, 31R by causing the elongated sheet to pass through the feeding route 39.

Further, when the elongated sheet is conveyed onto the tray 30, a lower face of the elongated sheet is brought into sliding contact with the curved parts 30*x*, 30*y*, 30*z*. If a friction between the elongated sheet and the tray 30 occurs at the time of conveying of the elongated sheets, a conveying resistance of the elongated sheet may increase, causing the skew of the elongated sheet. Therefore, by providing the curved parts 30*x*, 30*y*, 30*z*, since the friction between the elongated sheet and the tray 30 is reduced, the conveying load of the elongated sheets is reduced and therefore the elongated sheet can be conveyed more stably.

Figure 5:
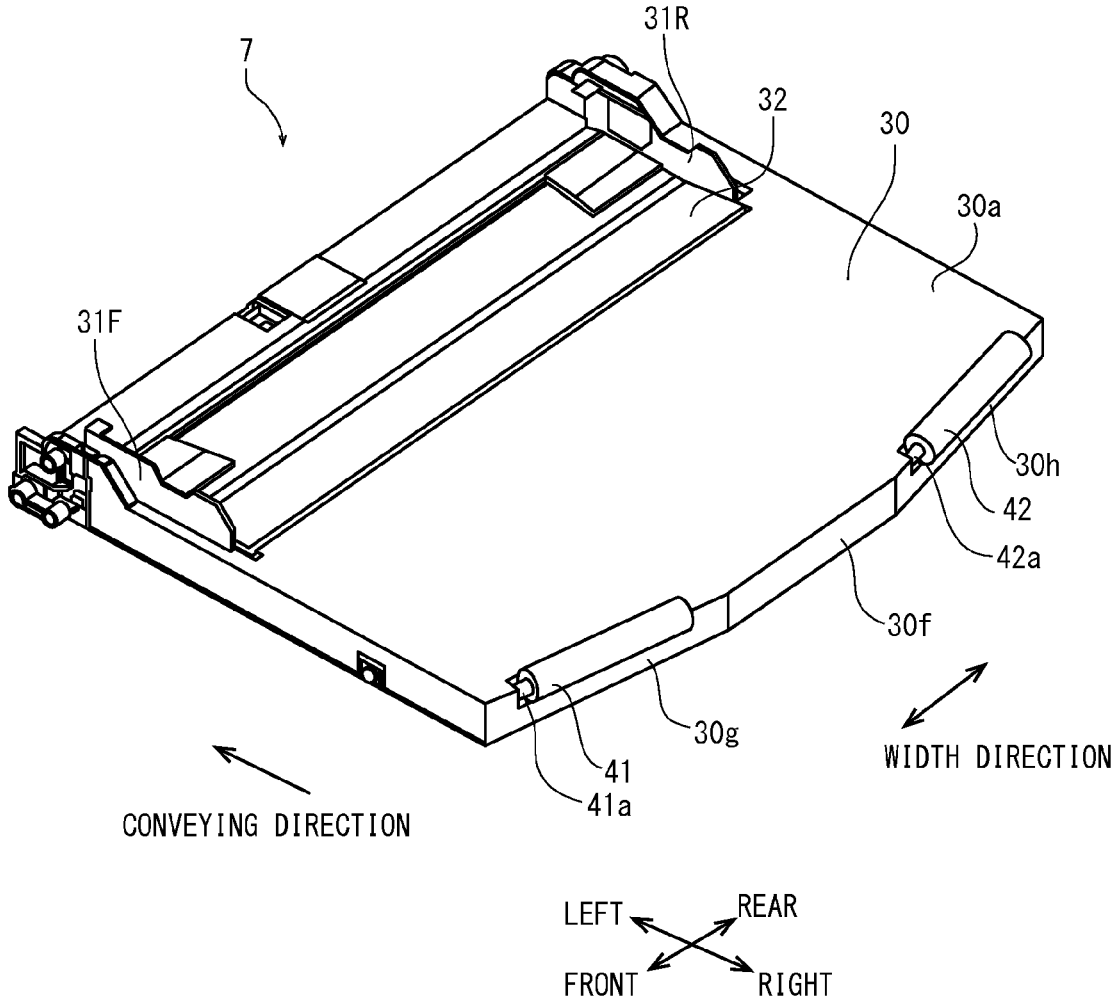
FIG. 5 is a perspective view of a sheet feeder according to a third embodiment of the present disclosure.

As shown in FIG. 5, in the manual sheet feeder 7 according to the third embodiment, at the corners of the upper face 30*a* of the tray 30, and the front end face 30*g* and the rear end face 30*h*, rollers 41, 42 are respectively supported. The respective rollers 41, 42 are supported so as to rotate about rotating shafts 41*a*, 42*a* in parallel to the front and rear end faces 30*g*, 30*h*.

In the manual sheet feeder according to the third embodiment, since both side edge portions of the elongated sheet in the width direction are respectively guided by the rollers 41, 42, in a case where the elongated sheet is conveyed onto the tray 30 whit a skew posture, the elongated sheet can be stably conveyed onto the tray 30 with the skew posture. Further, since the friction between the side edge portions of the elongated sheet and the tray 30 is reduced, the conveying load of the elongated sheet is reduced and thus the elongated sheet can be conveyed more stably.

Figure 6:
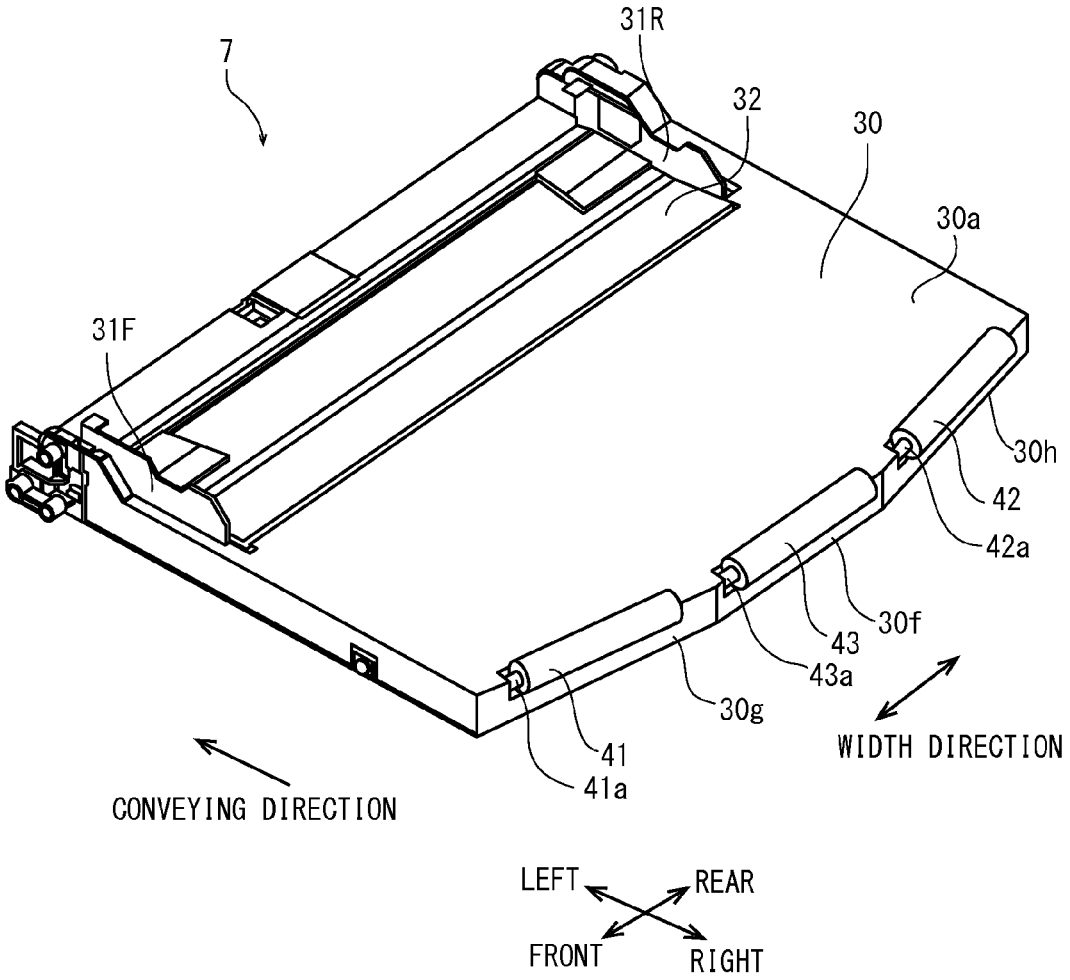
FIG. 6 is a perspective view of a sheet feeder according to a fourth embodiment of the present disclosure.

As shown in FIG. 6, in the manual sheet feeder 7 according to the fourth embodiment, a roller 43 is provided on the center end face 30*f* of the tray 30 as well. The roller 43 is supported at a corner between the center end face 30*f* of the tray 30 and the upper face 30*a* so as to rotate about a rotating shaft 43*a* in parallel to the sheet width direction.

In the manual sheet feeder 7 according to the fourth embodiment, since the elongated sheet is guided by the rollers 41, 42, 43 not only at the side edge portions but also over all area in the sheet width direction, the conveying resistance of the elongated sheet can be further reduced, and the elongated sheet can be stably conveyed.

Figure 7:
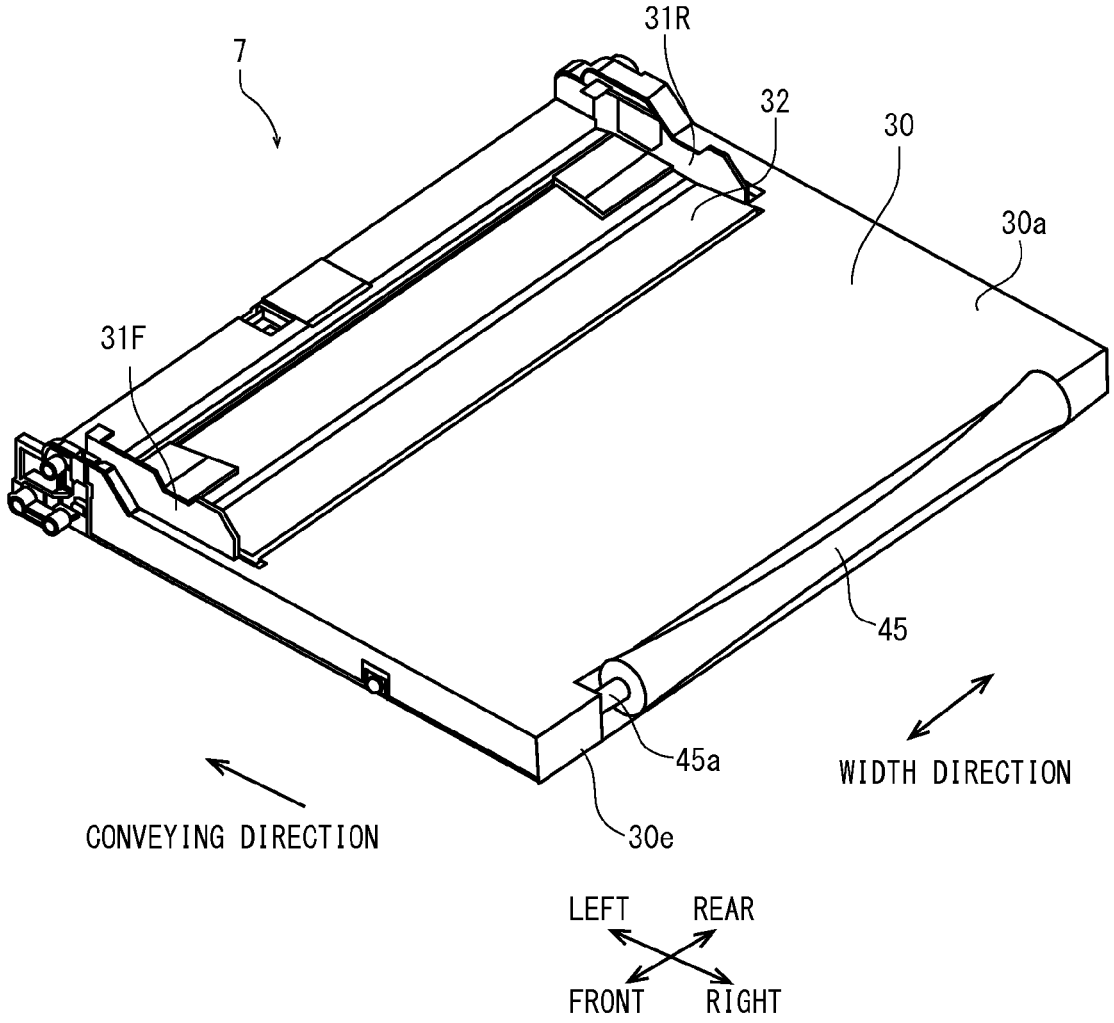
FIG. 7 is a perspective view of a sheet feeder according to a fifth embodiment of the present disclosure.
Figure 8:
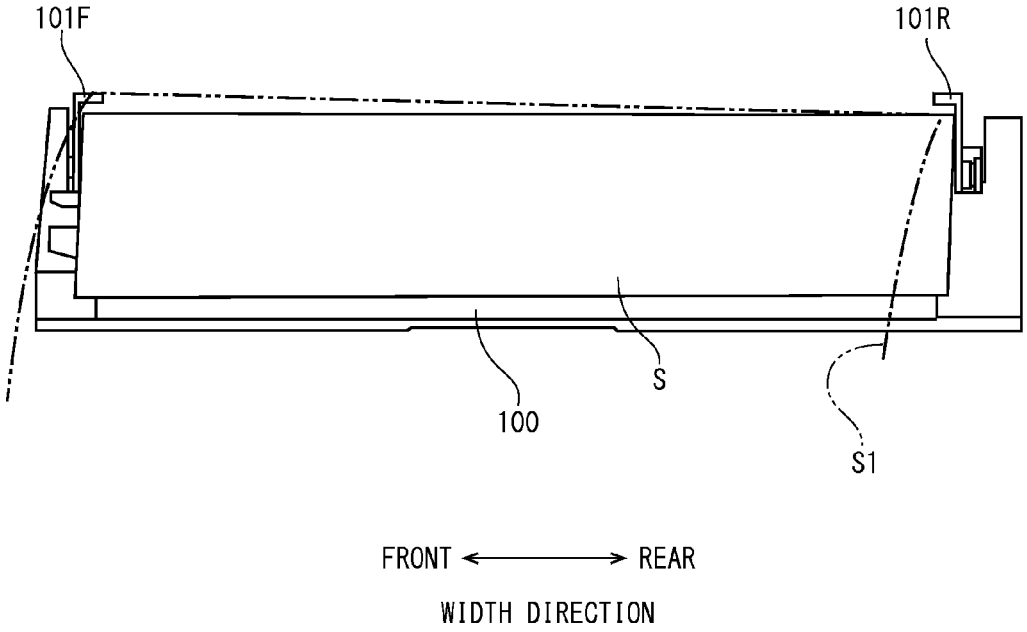
FIG.8 Related Art
FIG. 8 is a view showing an example of an oblique movement state of an elongated sheet in a conventional sheet feeder.

As shown in FIG. 7, in the manual sheet feeder 7 according to the fifth embodiment, a roller 45 provided at the corner between the upstream-side end face 30*e* of the tray 30 and the upper face 30*a* is formed to have a reversed crown shape in which an outer diameter is gradually increased from the center toward both ends in an axial direction.

In the manual sheet feeder 7 according to the fifth embodiment, since a rotational speed at both end portions of the roller 45 is faster than a rotational speed at the center portion, the elongated sheet is conveyed while the side edge portions preceding from the center portion. In this manner, the elongated sheet is conveyed with placing at the center in the sheet width direction and thus the skew hardly occurs.

The conveying resistance between the elongated sheet and the tray 30 is thus reduced and further the elongated sheet is conveyed through the feeding route 39, whereby the skew of the elongated sheet can be prevented more reliably.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A sheet feeder comprising:

a tray configured to load a sheet to be fed thereon, wherein the tray includes:

a tray upper face on which the sheet is placed; and a pair of cursors configured to be contact with side edges of the sheet placed on the tray upper face to align the sheet in a width direction of the sheet orthogonal to a feeding direction of the sheet, the tray upper face having:

a recessed portion extending along the width direction on an upstream side from the pair of cursors in the feeding direction;

a guide plate configured to cover an upper side of the recessed portion, constituting a part of the tray and configured to load a sheet to be fed; and a feeding route formed between the recessed portion and the guide plate and extending from an inlet port positioned on an upstream side to an outlet port positioned on a downstream side along the feeding direction, wherein the sheet in a state of being passed through the feeding route is aligned with the pair of cursors on the tray upper face and then fed.

2. The sheet feeder according to claim 1, wherein the feeding route has:

an upstream-side inclined route inclined obliquely downward from the upstream side to the downstream side in the feeding direction;

a linear route extending from a downstream-side end of the upstream-side inclined route in parallel to an upper face of the guide plate; and a downstream-side inclined route inclined obliquely upward from a downstream-side end of the linear route toward the downstream side in the feeding direction.

3. The sheet feeder according to claim 1, wherein the sheet is manually fed in either one of placement states of a first placement state and a second placement state, in which, in the first placement state, the sheet is placed in a state of being passed through the feeding route and then aligned with the pair of cursors on the tray upper face, and in a second placement state, the sheet is placed on the guide plate without passing through the feeding route and then aligned with the pair of cursors on the tray upper face.

4. The sheet feeder according to claim 1, wherein the tray is provided with at least one roller rotating in the feeding direction on an upstream-side end face in the feeding direction.

5. The sheet feeder according to claim 4, wherein the roller has a reversed crown shape in which an outer diameter is formed so as to gradually increase from a center toward both ends in an axial direction.

6. The sheet feeder according to claim 1, wherein the tray has a curved corner between an upstream-side end face in the feeding direction and the tray upper face.

7. The sheet feeder according to claim 1, wherein the tray has inclined upstream-side end faces inclined toward the downstream side in the feeding direction at both side ends in the width direction.

8. A sheet feeder comprising:

a tray configured to load a sheet to be fed thereon, wherein the tray includes:

a tray upper face on which the sheet is placed; and a pair of cursors configured to be contact with side edges of the sheet placed on the tray upper face to align the sheet in a width direction of the sheet orthogonal to a feeding direction of the sheet, the tray upper face having:

a recessed portion extending along the width direction on an upstream side from the pair of cursors in the feeding direction;

a guide plate configured to cover an upper side of the recessed portion, constituting a part of the tray and configured to load a sheet to be fed; and a feeding route formed between the recessed portion and the guide plate and extending from an inlet port positioned on an upstream side to an outlet port positioned on a downstream side along the feeding direction, wherein the sheet in a state of being passed through the feeding route is aligned with the pair of cursors on the tray upper face and then fed, wherein the pair of cursors are configured such that upstream-side end portions in the feeding direction can slide close to or spaced apart each other on the upper face of the guide plate about a center in the width direction.

9. A sheet feeder comprising:

a tray configured to load a sheet to be fed thereon, wherein the tray includes:

a tray upper face on which the sheet is placed; and a pair of cursors configured to be contact with side edges of the sheet placed on the tray upper face to align the sheet in a width direction of the sheet orthogonal to a feeding direction of the sheet, the tray upper face having:

a recessed portion extending along the width direction on an upstream side from the pair of cursors in the feeding direction;

a guide plate configured to cover an upper side of the recessed portion, constituting a part of the tray and configured to load a sheet to be fed; and a feeding route formed between the recessed portion and the guide plate and extending from an inlet port positioned on an upstream side to an outlet port positioned on a downstream side along the feeding direction, wherein the sheet in a state of being passed through the feeding route is aligned with the pair of cursors on the tray upper face and then fed, wherein the pair of cursors each have: a proximal part having a face along the tray upper face; and a side part erected from an outside edge in the width direction of the proximal part, and the outlet port is positioned on the upstream side from the proximal part in the feeding direction.

10. The sheet feeder according to claim 9, wherein the inlet port is positioned on the upstream side from the side part in the feeding direction.

11. A sheet feeder comprising:

a tray configured to load a sheet to be fed thereon, wherein the tray includes:

a tray upper face on which the sheet is placed; and a pair of cursors configured to be contact with side edges of the sheet placed on the tray upper face to align the sheet in a width direction of the sheet orthogonal to a feeding direction of the sheet, the tray upper face having:

a recessed portion extending along the width direction on an upstream side from the pair of cursors in the feeding direction;

a guide plate being arranged within the recessed portion, constituting a part of the tray and configured to load a sheet to be fed; and a feeding route formed between the recessed portion and the guide plate and extending from an inlet port positioned on an upstream side to an outlet port positioned on a downstream side along the feeding direction, wherein the sheet in a state of being passed through the feeding route is aligned with the pair of cursors on the tray upper face and then fed.

12. The sheet feeder according to claim 11, wherein the guide plate is configured to have an upper face substantially on the same plane with the tray upper face.

13. An image forming apparatus comprising:

an image forming part;

a sheet feeding part configured to convey a sheet to the image forming part; and a sheet feeder according to claim 11, the sheet feeder being configured to feed the sheet to the sheet feeding part.

14. The image forming apparatus according to claim 13, wherein the pair of cursors each have: a proximal part having a face along the tray upper face; and a side part erected from an outside edge in the width direction of the proximal part, the outlet port is positioned on the upstream side from the proximal part in the feeding direction and the inlet port is positioned on the upstream side from the side part in the feeding direction.

15. An image forming method for forming an image by using the image forming apparatus according to claim 14 comprising the steps of:

inserting a leading end of the sheet into the feeding route from the inlet port and then pulling out the sheet from the outlet port;

passing the leading end of the pulled out sheet through the upper face of the proximal part between the side parts of the pair of cursors and then setting the sheet so as to be able to be fed from the sheet feeding part; and feeding the leading end of the sheet from the sheet feeding part and then conveying the sheet to the image forming part along the conveying direction.

* * * * *